US006755170B2

(12) United States Patent
Morishige et al.

(10) Patent No.: US 6,755,170 B2
(45) Date of Patent: Jun. 29, 2004

(54) RECOIL STARTER

(75) Inventors: Toshinori Morishige, Tokyo (JP); Isao Tohyama, Tokyo (JP)

(73) Assignee: Starting Industrial Co., Ltd. (JP)

( * ) Notice: Subject to any disclaimer, the term of this patent is extended or adjusted under 35 U.S.C. 154(b) by 50 days.

(21) Appl. No.: 10/292,988

(22) Filed: Nov. 13, 2002

(65) Prior Publication Data

US 2003/0094154 A1 May 22, 2003

(30) Foreign Application Priority Data

Nov. 16, 2001 (JP) ..... 2001-351117

(51) Int. Cl.[7] ..... F02N 3/02; F02N 1/00
(52) U.S. Cl. ..... 123/185.3
(58) Field of Search ..... 123/185.2, 185.3, 123/185.4, 185.14; 185/39, 40 R, 41 R, 41 A, 41 C

(56) References Cited

U.S. PATENT DOCUMENTS

| | | | | | |
|---|---|---|---|---|---|
| 2,181,805 | A | * | 11/1939 | Fritz | 123/185.3 |
| 3,010,443 | A | | 11/1961 | Lyvers | |
| 3,140,703 | A | | 7/1964 | Barr | |
| 3,306,277 | A | | 2/1967 | Gundmundsen | |
| 3,570,464 | A | | 3/1971 | Morabit et al. | |
| 4,291,654 | A | * | 9/1981 | Obermayer | 123/185.3 |
| 4,480,605 | A | * | 11/1984 | Bloemers | 123/185.3 |
| 4,922,868 | A | | 5/1990 | Ohkanda | |
| 5,287,832 | A | | 2/1994 | Uhl | |
| 5,537,966 | A | | 7/1996 | Ohnishi | |
| 5,715,783 | A | * | 2/1998 | Osakabe et al. | 123/185.3 |
| 5,970,940 | A | | 10/1999 | Penton | |
| 2001/0047786 | A1 | | 12/2001 | Kawasaki et al. | |
| 2002/0121257 | A1 | | 9/2002 | Morishige et al. | |
| 2003/0015162 | A1 | | 1/2003 | Harada et al. | |

FOREIGN PATENT DOCUMENTS

| | | |
|---|---|---|
| JP | 1-91075 A1 | 6/1989 |
| JP | 6-16964 A1 | 5/1994 |
| JP | 7-17810 A1 | 4/1995 |

* cited by examiner

*Primary Examiner*—Mahmoud Gimie
*Assistant Examiner*—Arnold Castro
(74) *Attorney, Agent, or Firm*—Lerner, David, Littenberg, Krumholz & Mentlik, LLP

(57) ABSTRACT

A recoil starter capable of starting an engine easily has a reduced number of components and a simple structure, and enables miniaturization and a cost reduction. A damper spring having one end thereof fixed to a reel and provided at the other end thereof with an operation section is arranged in such a manner that the operation section thereof is engageable with a centrifugal ratchet provided on a rotating member of the engine, so that a shock caused by the engine is absorbed by the damper spring and a rotating force from the reel is stored therein.

11 Claims, 4 Drawing Sheets

RECOIL STARTER

BACKGROUND OF THE INVENTION

1. Field of the Invention

The present invention relates to a recoil starter, wherein a recoil rope wound around a reel is pulled so as to rotate the reel, and thus transmit rotation of the reel to a rotating member connected to an engine through a centrifugal ratchet, to thereby start the engine by means of rotation of the rotating member.

2. Description of the Related Art

A conventionally known recoil starter is constituted, as shown in FIG. 6, so that a reel 21, which is rotatably supported in a casing 20 and which has a rope 22 wound therearound and a cam 23 formed thereon, and a centrifugal ratchet 24 provided on a pulley 25 connected with a crank shaft of an engine are arranged in association with each other so as to permit the cam 23 to be engaged with the centrifugal ratchet 24. When the rope 22 wound around the reel 21 is pulled to rotate the reel 21, the pulley 25 is driven to be rotated via the cam 23 on the real 21 and the centrifugal ratchet 24 on the pulley 25, whereby the engine is started. Another conventional recoil starter includes, as shown in FIG. 7, a centrifugal ratchet 24 which is provided on a flywheel magnet 26 coupled with a crank shaft of an engine so as to be engageable with a cam 23 formed on a reel 21. However, in the conventional recoil starters having the above structure where the cam 23 and the reel 21 are integrally formed, a shock caused at a compression stroke of the engine during a starting operation is transmitted directly to a hand of an operator which pulls the rope 22 via a rotating member coupled with the crank shaft, such as the pulley 25 or the flywheel magnet 26. For this reason, the starting is troublesome. In addition, when the engine is stopped, a shock of engagement between the ratchet and the cam due to reverse rotation of the engine is transmitted to the entire recoil starter, thereby causing damage to the recoil starter.

In order to solve the above problem, a recoil starter provided with a damper spring which is disposed between a reel and a cam so that the reel and the cam are connected with each other therethrough was proposed and is disclosed in Japanese Utility Model Publication No. 6-16964. In this technique, the cam which is rotatable in relation to the reel is provided, and the cam and the reel are connected by the damper spring, so that an abrupt load at the time of starting the engine is absorbed by deformation of the damper spring, whereby an impulsive load is attenuated and simultaneously a rotating force is stored. When the load becomes small after the compression stroke, the rotating force which has been stored in the damper spring is discharged so as to acceleratingly rotate the pulley and facilitate the starting of the engine. Moreover, when the engine is stopped, a shock of the engagement due to the reverse rotation of the engine is absorbed by the damper spring, leading to an advantage that the starter is not overstrained.

However, in the technique described above, it is required that the cam which is engageable with the centrifugal ratchet disposed on the pulley be arranged so as to be rotatable in relation to the reel and that a member for rotatably supporting the cam be provided. Further, a large space is necessary to receive the cam and the damper spring connected to the cam. Therefore, this technique has problems in that the structure of the starter becomes complicated and thus miniaturization of the starter becomes difficult.

SUMMARY OF THE INVENTION

The present invention has been made in view of the foregoing disadvantages of the prior art.

Therefore, it is an object of the present invention to provide a recoil starter which has a reduced number of components and a simple structure, and which enables miniaturization and a cost reduction.

In accordance with the present invention, a recoil starter for an engine is provided. The recoil starter comprises: a rotatable reel; a recoil rope wound around the reel and arranged so as to drive the reel to rotate it; a recoil spring for urging the reel in a rope rewinding direction; a centrifugal ratchet provided on a rotating member of the engine; and a damper spring disposed between the reel and the centrifugal ratchet; wherein the damper spring has one end fixed to the reel and is provided at the other end thereof with an operation section; and the operation section of the damper spring is arranged to disengageably engage with the centrifugal ratchet so as to transmit rotation of the reel rotated by the recoil rope to the rotating member of the engine through the ratchet, so that a shock caused by the engine is absorbed by the damper spring and a rotating force on the reel is stored by the damper spring.

In a preferred embodiment of the present invention, the reel is formed therein with an annular recess facing the rotating member of the engine, in which recess the damper spring is received.

In a preferred embodiment of the present invention, the recoil starter further comprises a casing for receiving therein the reel, wherein the casing is provided on an inner surface thereof with a shaft for rotatably supporting the reel, which shaft is protruded from the inner surface and formed concentrically with the annular recess of the reel.

In a preferred embodiment of the present invention, the annular recess of the reel is provided on a bottom thereof with a holding protrusion; and the damper spring comprises a torsion coil spring which is provided at the one end thereof with an engaging portion engaged with the holding protrusion and provided at the other end thereof with the operation section formed by a portion protruding from an outer periphery of the torsion spring and being bent into an axial direction.

In a preferred embodiment of the present invention, the rotating member of the engine comprises a pulley connected to a crank shaft of the engine. Alternatively, the rotating member of the engine may comprise a flywheel magnet operatively connected to a crank shaft of the engine.

DETAILED DESCRIPTION OF THE INVENTION

Hereinafter, the present invention will be explained specifically based on preferred embodiments shown in the accompanying drawings.

Figure 1:
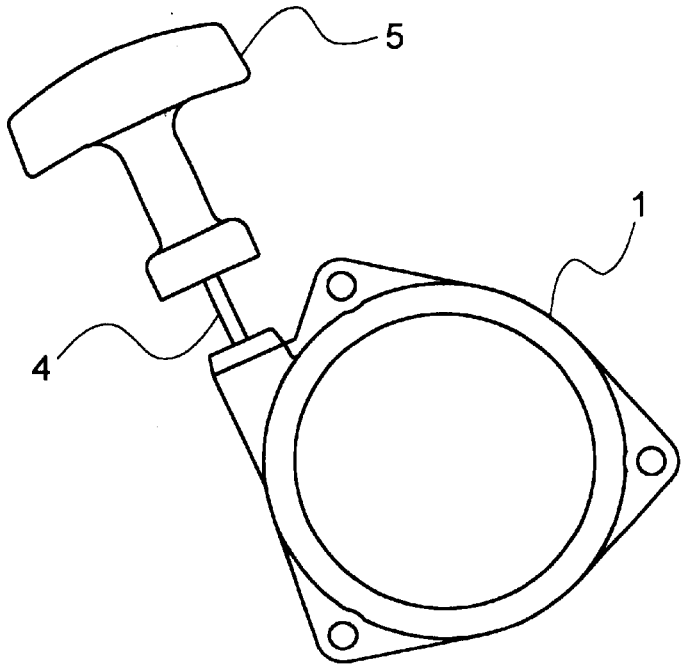
FIG. 1 is a front view showing a recoil starter according to an embodiment of the present invention.
Figure 2:
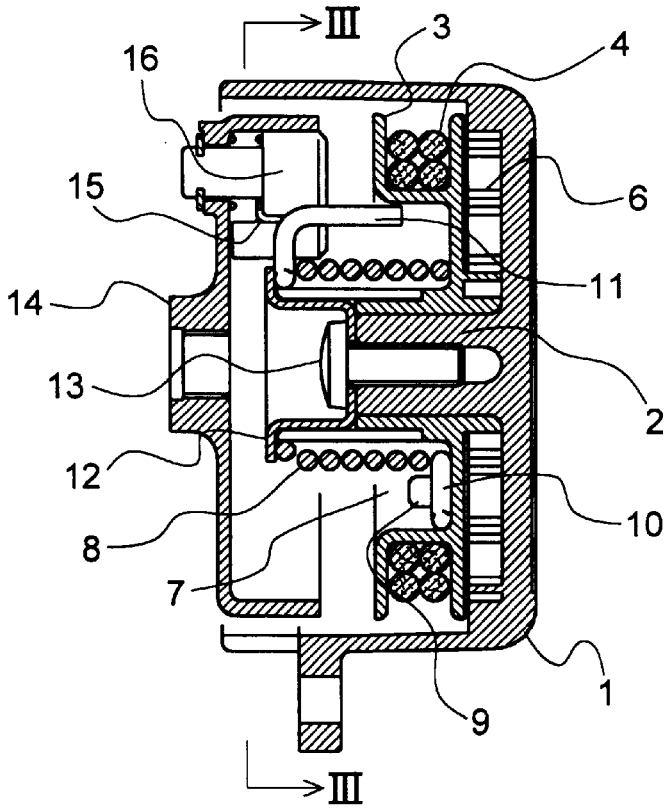
FIG. 2 is a side elevational view in section showing the recoil starter of FIG. 1.
Figure 3:
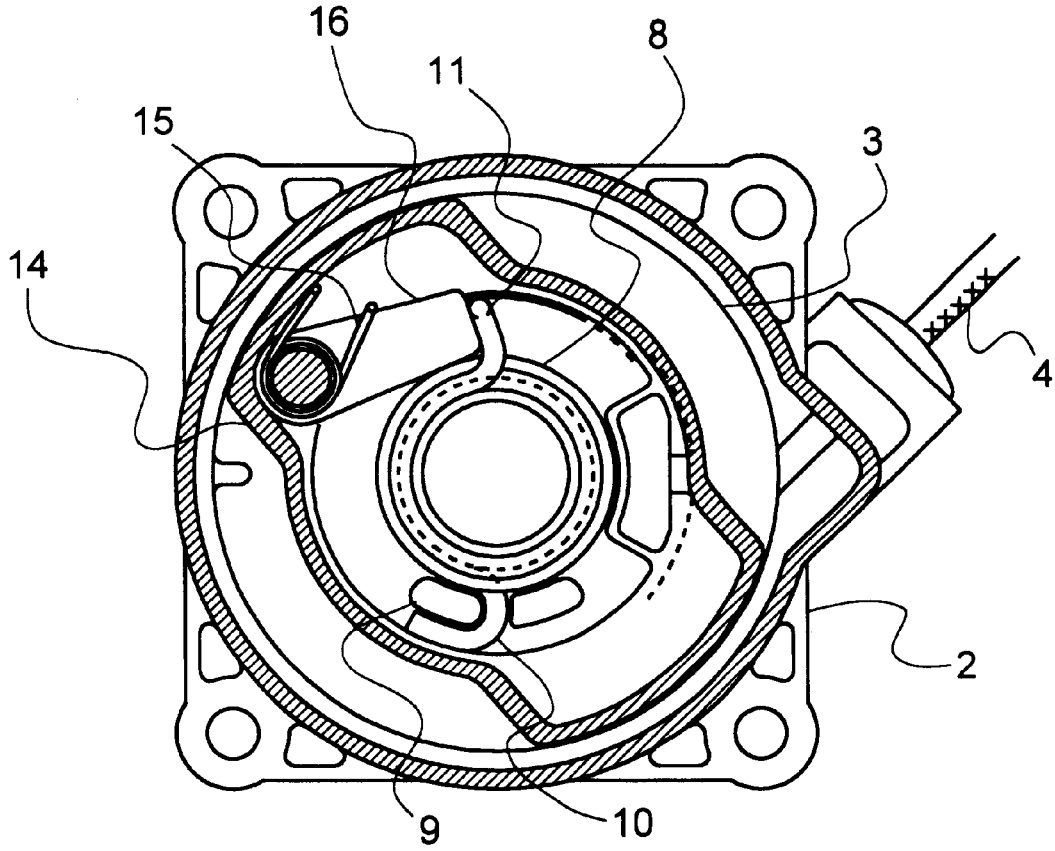
FIG. 3 is a cross sectional view taken along line III—III in FIG. 2.

Referring first to FIGS. 1 to 3, a recoil starter according to an embodiment of the present invention is illustrated. A recoil starter is constituted so that a reel 3 is rotatably supported on a supporting shaft 2 formed to be protruded from an inner surface of a casing 1, a recoil rope 4 having one end thereof fixed to the reel 3 is wound around the reel 3 and the other end thereof is drawn out of the casing 1. The extremity of the other end of the recoil rope 4 is connected with a handle 5 for pulling the recoil rope 4 manually. The handle 5 is pulled so that the recoil rope 4 is drawn out of the reel 3, whereby the reel 3 is driven to be rotated about the supporting shaft 2. A recoil spring 6 is disposed adjacent to the reel 3 so as to urge the reel 3 in a rope rewinding direction, to thereby rotate the reel 3 which has been rotated by the recoil rope 4 in the reverse direction and rewind the unwound recoil rope 4 around the reel 3. One end of the recoil spring 6 is fixed to the casing 1 and the other end thereof is fixed to the reel 3. When the recoil rope 4 is pulled so as to rotate the reel 3, a rotating force is stored in the recoil spring 6, and when the recoil rope 4 is released, the reel 3 is rotated in the reverse direction due to the stored rotating force so that the recoil rope 4 is rewound around the reel 3.

Figure 4:
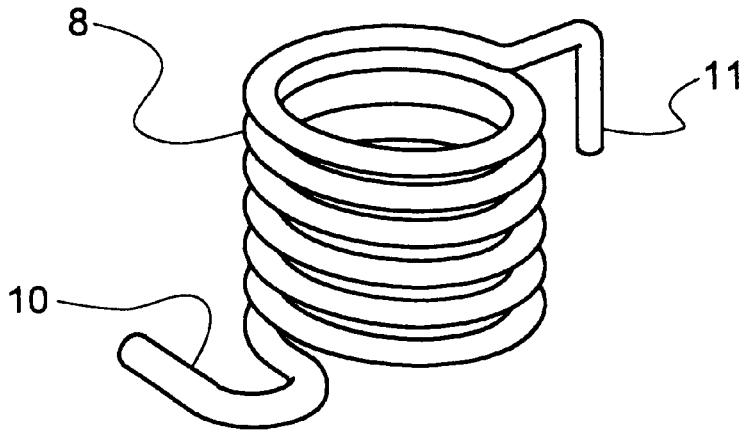
FIG. 4 is a perspective view showing a damper spring.

The reel 3 is formed on the side surface thereof with an annular recess 7 which faces to the inside of the casing 1 and which is concentric with the supporting shaft 2. A damper spring 8 is received in the recess 7 of the reel 3. As shown in FIG. 4, the damper spring 8 comprises a torsion coil spring and is provided at one end thereof with an engaging section 10 which is held on a holding protrusion 9 formed at the bottom of the recess 7 of the reel 3. The damper spring 8 is provided at the other end thereof with an operation section 11 which is formed by a portion protruding from the outer periphery of the damper spring and being bent into an axial direction. A retainer plate 12 is mounted to a distal end of the supporting shaft 2 formed on the inner side of the casing 1 by a screw 13 so that the retainer plate 12 prevents the damper spring 8 received in the recess 7 of the reel 3 from being disengaged from the recess 7. As a result, the damper spring 8, together with the reel 3, is rotated in both normal and reverse directions when the reel 3 is rotated.

In this embodiment, a pulley 14, which is a rotating member rotatable in conjunction with a crank shaft (not shown) of an engine, is connected with the crank shaft of the engine and arranged so as to be opposed to the operation section 11 of the damper spring 8. The pulley 14 is provided thereon with a centrifugal ratchet 16 which is biased by a spring 15 so as to be normally located at a first position or inner position. When the engine is started and the crank shaft is rotated, the centrifugal ratchet 16 is moved to a second position or outer position against the spring 15 by a centrifugal force. The operation section 11 of the damper spring 8 is arranged so as to be engaged with and disengaged from the centrifugal ratchet 16. When the engine is not started, the operation section 11 of the damper spring 8 comes in contact with the centrifugal ratchet 16 located at the inner position, but after the engine is started, the operation section 11 does not come in contact with the centrifugal ratchet 16 located at the outer position.

Now, there will be explained an operation of the recoil starter of the illustrated embodiment. In a state before the engine starts as shown in FIG. 3, the centrifugal ratchet 16 on the pulley 14 connected to the crank shaft of the engine is located at the inner position by an action of the spring 15, wherein the operation section 11 of the damper spring 8 is permitted to come into contact with the centrifugal ratchet 16. When the recoil rope 4 is pulled, the reel 3 is rotated and the damper spring 8, together with the reel 3, is rotated. The operation section 11 of the damper spring 8 is brought into contact with the centrifugal ratchet 16, whereby the pulley 14 is rotated via the centrifugal ratchet 16. During this operation, the crank shaft connected to the pulley 14 is rotated, but at this time a rotation load abruptly increases due to a starting resistance of the engine and thus the rotation load of the pulley 14 becomes large. However, since the damper spring 8 is twisted so as to absorb such a load, a shock is not transmitted directly to the pulley 3 and the recoil rope 4. Moreover, at this time, the rotation force of the reel 3 is stored by the damper spring 8.

When, the reel 3 is further rotated and the rotating force of the reel exceeds the starting resistance of the engine, the rotating force of the reel 3 and the rotating force stored by the damper spring 8 which is discharged are transmitted to the pulley 14. For this reason, the crank shaft is rotated at a dash so that the engine is started. When the engine is started and the crank shaft is rotated, the centrifugal ratchet 16 is moved to the outer position by the centrifugal force so as not to come in contact with the operation section 11 of the damper spring 8. When the recoil rope 4 is loosened after the starting of the engine, the rotating force stored by the recoil spring 6 rotates the reel 3 in the reverse direction so that the recoil rope 4 is rewound around the reel 3.

At this time, the damper spring 8 corotates with the reel 3 in the reverse direction. However, since the centrifugal ratchet 16 has been moved to the outer position as described above, the damper spring 8 can rotate without coming into contact with the centrifugal ratchet 16. In some rare cases where the engine is not started by a single operation, and when the recoil rope 4 is returned or loosened for re-operation, the damper spring 8, together with the reel 3, rotates in the reverse direction. However, since a side surface of the centrifugal ratchet 16 comes in contact with the operation section 11 of the damper spring 8 so as to be moved away to the outer position against an urging force of the spring 15, the rotation of the damper spring 8 in the reverse direction is not precluded.

Figure 5:
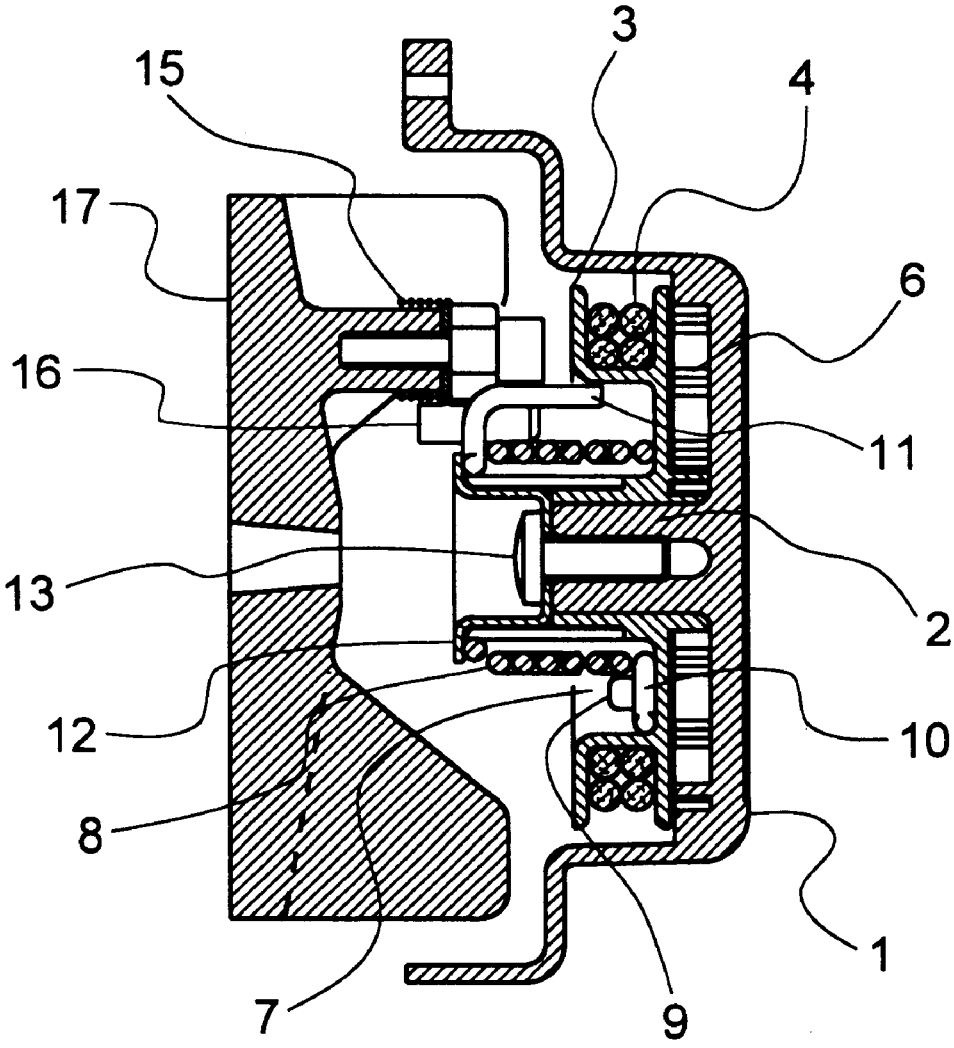
FIG. 5 is a side elevational view in section showing a recoil starter according to another embodiment of the present invention.
Figure 6:
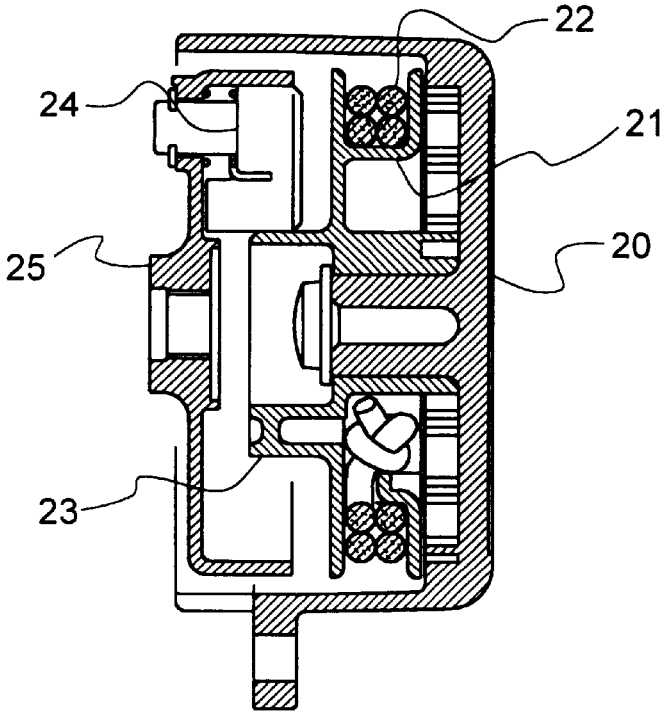
FIG. 6 PRIOR ART
FIG. 6 is a side elevational view in section showing a structure of a conventional recoil starter.
Figure 7:
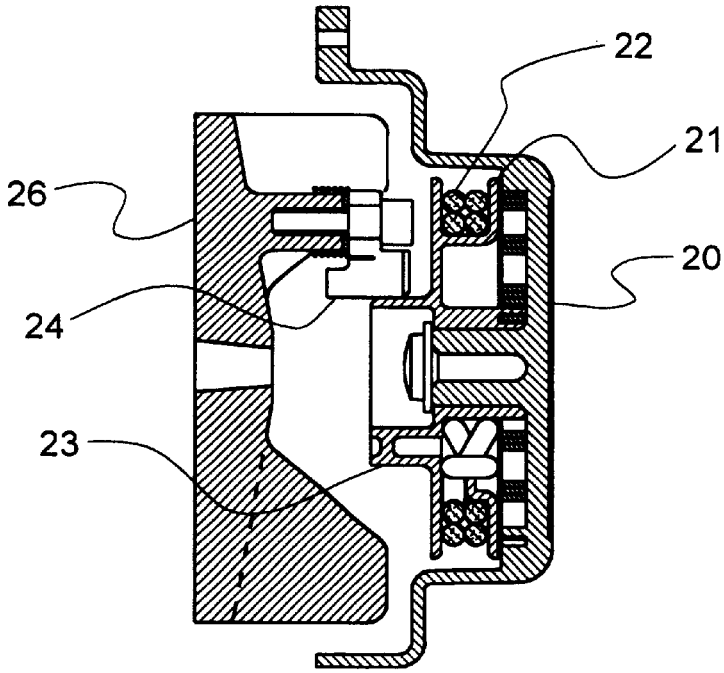
FIG. 7 PRIOR ART
FIG. 7 is a side elevational view in section showing a structure of another conventional recoil starter.

Now, referring to FIG. 5, another embodiment of the present invention is illustrated therein. In the illustrated embodiment, a centrifugal ratchet 16 is provided on a rotating member which is rotated together with the crank shaft of the engine, i.e., a flywheel magnet 17 disposed in the engine. The centrifugal ratchet 16 is arranged so as to be opposed to an operation section 11 of a damper spring 8 having the same structure as that in the embodiment described above. The arrangement of the remaining parts is the same as that in the embodiment described above. In this embodiment, the flywheel magnet 17 provided as a part of the engine structure can be utilized as the rotating member of the engine, so that a pulley 14 used in the embodiment described above is not required, resulting in manufacturing costs being reduced.

According to the present invention, since the damper spring is interposed between the rotating member of the engine and the reel, even when a load of the engine changes abruptly, the load is absorbed by the damper spring, so that an impulsive load on the reel is attenuated. Moreover, in the case where the load of the engine is large, the rotating force, which has been stored by the damper spring, is discharged at a dash so that the rotating member of the engine is rotated when the load is relieved, resulting in the starting of the engine being facilitated. Further, one end of the damper spring is fixed to the reel, and the other end thereof is provided with the operation section so as to be brought into contact with the centrifugal ratchet. For this reason, a cam engageable with the centrifugal ratchet and a structure for supporting the cam are not required, unlike in the conventional technique, whereby the structure of the recoil starter is simplified. This enables miniaturization of the recoil starter and a cost reduction.

What is claimed is:

1. A recoil starter for an engine having a rotating member, comprising:

a rotatable reel;

a recoil rope wound around said reel and arranged so as to drive said reel to rotate it;

a recoil spring for urging said reel in a rope rewinding direction;

a centrifugal ratchet provided on said rotating member of the engine; and a damper spring disposed between said reel and said centrifugal ratchet;

wherein said damper spring has one end fixed to said reel and is provided at the other end thereof with an operation section; and said operation section of said damper spring is arranged to disengageably engage with said centrifugal ratchet so as to transmit rotation of said reel rotated by said recoil rope to said rotating member of the engine through said ratchet, so that a shock caused by the engine is absorbed by said damper spring and a rotating force on said reel is stored by said damper spring.

2. The recoil starter according to claim 1, wherein said reel is formed therein with an annular recess facing said rotating member of the engine, in which recess said damper spring is received.

3. The recoil starter according to claim 2, further comprising a casing for receiving therein said reel, wherein said casing is provided on an inner surface thereof with a shaft for rotatably supporting said reel, which shaft is protruded from said inner surface and formed concentrically with said annular recess of said reel.

4. The recoil starter according to claim 2, wherein said annular recess of said reel is provided on a bottom thereof with a holding protrusion; and said damper spring comprises a torsion coil spring which is provided at the one end thereof with an engaging portion engaged with said holding protrusion and provided at the other end thereof with said operation section formed by a portion protruding from an outer periphery of said torsion spring and being bent into an axial direction.

5. The recoil starter according to claim 3, wherein said annular recess of said reel is provided on a bottom thereof with a holding protrusion; and said damper spring comprises a torsion coil spring which is provided at the one end thereof with an engaging portion engaged with said holding protrusion and provided at the other end thereof with said operation section formed by a portion protruding from an outer periphery of said torsion spring and being bent into an axial direction.

6. The recoil starter according to claim 1, wherein said rotating member of the engine comprises a pulley connected to a crank shaft of the engine.

7. The recoil starter according to claim 2, wherein said rotating member of the engine comprises a pulley connected to a crank shaft of the engine.

8. The recoil starter according to claim 3, wherein said rotating member of the engine comprises a pulley connected to a crank shaft of the engine.

9. The recoil starter according to claim 1, wherein said rotating member of the engine comprises a flywheel magnet operatively connected to a crank shaft of the engine.

10. The recoil starter according to claim 2, wherein said rotating member of the engine comprises a flywheel magnet operatively connected to a crank shaft of the engine.

11. The recoil starter according to claim 3, wherein said rotating member of the engine comprises a flywheel magnet operatively connected to a crank shaft of the engine.

* * * * *